US007174938B2

(12) United States Patent
Cadieux, Jr. et al.

(10) Patent No.: US 7,174,938 B2
(45) Date of Patent: Feb. 13, 2007

(54) APPARATUS FOR FOLDING AND APPLYING ONSERTS ONTO CONSUMER GOODS

(75) Inventors: Edmond J. Cadieux, Jr., Midlothian, VA (US); Steve Campbell, Mechanicsville, VA (US); James D. Evans, Chesterfield, VA (US); Steven R. Rinehart, Chesterfield, VA (US); G. Robert Scott, Midlothian, VA (US); Barry S. Smith, Hopewell, VA (US); Steven F. Spiers, Richmond, VA (US); Linwood H. Cameal, Jr., Richmond, VA (US); Hubert Coleman Goodman, Jr., Midlothian, VA (US); Joshua L. Roby, Mechanicsville, VA (US)

(73) Assignee: Philip Morris USA Inc., Richmond, VA (US)

( * ) Notice: Subject to any disclaimer, the term of this patent is extended or adjusted under 35 U.S.C. 154(b) by 229 days.

(21) Appl. No.: 10/785,552

(22) Filed: Feb. 24, 2004

(65) Prior Publication Data

US 2004/0242393 A1 Dec. 2, 2004

Related U.S. Application Data

(60) Provisional application No. 60/449,749, filed on Feb. 25, 2003.

(51) Int. Cl.
*B31F 1/00* (2006.01)

(52) U.S. Cl. ..... 156/461; 156/557; 493/344; 493/356; 493/360; 493/363; 283/81

(58) Field of Classification Search ..... 156/227, 156/557, 539, 264, 517, 459; 493/361, 362, 493/343, 344, 356, 357, 360, 363, 419; 283/81; 198/689.1

See application file for complete search history.

(56) References Cited

U.S. PATENT DOCUMENTS

| | | | | |
|---|---|---|---|---|
| 1,818,923 | A | 8/1931 | Taylor | |
| 1,913,642 | A | 6/1933 | Smith | |
| 2,011,399 | A | 8/1935 | Driscoll | |
| 3,089,695 | A | 5/1963 | Brooks | |
| 3,695,422 | A | 10/1972 | Tripodi | |
| 3,897,293 | A | 7/1975 | Babcock | |
| 4,071,997 | A * | 2/1978 | Gunther et al. | 53/429 |
| 4,125,254 | A | 11/1978 | Boyer | |
| 4,225,128 | A | 9/1980 | Holyoke | |
| 4,275,977 | A * | 6/1981 | Joice | 414/790.9 |

(Continued)

*Primary Examiner*—Richard Crispino
*Assistant Examiner*—Barbara J Musser
(74) *Attorney, Agent, or Firm*—Connolly Bove Lodge & Hutz LLP

(57) ABSTRACT

A machine for folding and applying onserts onto consumer goods such as cigarette packs comprises a continuous roll of preprinted onserts and a transverse cutter assembly for cutting onsert segments from the continuous roll. Each onsert segment includes a pair of side-by-side preprinted onserts. A buckle folder receives each cut onsert segment and folds that segment along at least one transverse fold line. A longitudinal cutter assembly longitudinally cuts each folded onsert segment into two individual onserts. A transport system serially receives the individual folded onserts and moves the onserts along dual diverging paths where a pair of spaced apart lug belt conveyors receives the onserts from the discharge end of the transport system. Each lug belt conveyor includes spaced apart transverse lugs along the length thereof against which the onserts are positioned. A pair of spaced apart applicator wheels transfers the onserts from the conveyors onto spaced apart consumer goods traveling past the applicator wheels.

5 Claims, 2 Drawing Sheets

U.S. PATENT DOCUMENTS

| | | | | |
|---|---|---|---|---|
| 4,351,679 | A | 9/1982 | Dreher | |
| 4,425,181 | A * | 1/1984 | Bahr et al. | 156/497 |
| 4,605,459 | A | 8/1986 | Voltmer et al. | |
| 4,655,871 | A | 4/1987 | Mattei et al. | |
| 4,812,195 | A * | 3/1989 | Vijuk | 156/357 |
| 5,044,873 | A | 9/1991 | Vijuk | |
| 5,111,633 | A | 5/1992 | Draghetti | |
| 5,242,364 | A | 9/1993 | Lehmann | |
| 5,607,526 | A | 3/1997 | Buckley | |
| 5,983,600 | A | 11/1999 | Heide et al. | |
| 6,036,006 | A | 3/2000 | Focke | |
| 6,105,340 | A | 8/2000 | Draghetti | |
| 6,216,860 | B1 | 4/2001 | Boriani et al. | |
| 6,224,560 | B1 | 5/2001 | Gazula et al. | |
| 6,230,474 | B1 | 5/2001 | Giacoman | |
| 6,401,918 | B1 | 6/2002 | Focke et al. | |
| 6,438,927 | B1 | 8/2002 | Focke et al. | |
| 6,467,614 | B1 | 10/2002 | Tallier et al. | |
| 6,475,129 | B1 | 11/2002 | Lehmann | |
| 6,591,584 | B1 | 7/2003 | Saito | |
| 6,615,980 | B2 | 9/2003 | Draghetti et al. | |
| 6,669,015 | B2 | 12/2003 | Draghetti et al. | |
| 6,755,010 | B2 | 6/2004 | Draisey | |
| 2002/0185232 | A1 | 12/2002 | Draghetti et al. | |

* cited by examiner

Vacuum
Vacuum
M

APPARATUS FOR FOLDING AND APPLYING ONSERTS ONTO CONSUMER GOODS

CROSS-REFERENCE TO RELATED APPLICATION

The present application in entitled to the benefits of provisional application Ser. No. 60/449,749, filed Feb. 25, 2003, and that application is incorporated herein in its entirety for all useful purposes.

BACKGROUND OF THE INVENTION

The present invention relates to a machine for folding and applying onserts onto consumer goods, such as cigarette packs, and more particularly to a machine for folding onserts in side-by-side pairs from an endless roll of preprinted material, cutting the pairs into individual folded onserts, and transporting the onserts along dual paths for application to cigarette packs traveling along dual paths.

Particularly in the case of cigarette packs, there is an increasing need for the packs to include printed onserts containing information about the cigarettes and/or serving as a medium for advertising purposes. In other instances, such onserts may take the form of a coupon providing eligibility for the consumer to participate in prize drawings and the like. In the case of cigarette packs which are usually provided with an outer wrap of transparent film, printed onserts may be positioned between the pack and the outer wrap whereby the onsert can be seen from the outside when the pack and outer wrap are still intact. When positioned between the pack and the outer wrap the onsert may be placed directly onto the pack and subsequently wrapped, or the onsert may be initially placed onto the flexible outer wrap before the pack is wrapped with such material.

Currently many onserts are pre-folded and delivered to cigarette packs via stacks of individual pre-folded onserts. Disadvantages of this approach involve the overall expense and difficulty of making pre-folded bobbins or stacks of individual printed onsert material. Moreover, individual onserts are difficult to handle at cigarette packaging machines that operate at extremely high production speeds in that the onserts tend to jam quite easily, and therefore require intensive operator intervention for feeding them to applicators that deliver and apply the onserts to the cigarette packs.

SUMMARY OF THE INVENTION

Accordingly, one of the objects of the present invention is an in-line onsert folder system that includes a continuous roll of unfolded printed onserts with a transverse cutter head that transversely cuts onserts from the continuous roll, and a folder for folding the onserts and delivering them to an applicator for placement directly onto consumer packs such as cigarette packs.

Another object of the present invention is an in-line onsert folder system that includes a buckle folder with wide rollers that function to fold a pair of onserts in side-by-side relationship, and a longitudinal cutter assembly that cuts the pair of folded onserts into individual onserts before being fed along dual paths for application onto consumer packs such as cigarette packs traveling along dual paths.

In accordance with the present invention, an in-line onsert folder system comprises a continuous roll of preprinted onserts, and a transverse cutter assembly constructed and arranged to cut a pair of onserts in side-by-side relationship from the roll. The pair of printed onserts in flat unfolded condition are delivered in a downstream direction to a buckle folder that receives the pair and folds them as a single unit along at least one fold line. The pair of folded onserts are then cut into individual units and conveyed in a downstream direction along dual diverging paths. A pair of spaced apart lug belt conveyors receive the folded onserts from the exit end of the dual diverging paths, and the onserts rest upon equally spaced apart lugs on the conveyors. The lugs on each conveyor are equally spaced apart approximately the same distance as the spacing between traveling consumer packs to which the onserts are applied. An applicator arrangement adjacent each lug belt conveyor transfers and directly applies the onserts to the consumer packs.

In a preferred embodiment of the present invention both applicator arrangements are adjacent dual streams of spaced apart consumer packs, and each arrangement applies the folded onserts directly onto the packs of each stream before the placement of flexible outer wrap around the packs. Glue may be applied to each onsert or to each pack prior to placement of the onserts on the packs.

The present invention is also directed to a method of folding preprinted onserts and applying the folded onserts onto consumer packs. The method includes the steps of providing a continuous roll of preprinted onserts and cutting onserts from the roll. The cut onserts are serially conveyed in a downstream direction and subsequently folded along at least one fold line. The folded onserts are then supplied along dual paths for application to consumer packs also traveling along dual paths before placement of flexible outer wrap around the packs.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figures 1, 2, 3, 3A, 4:
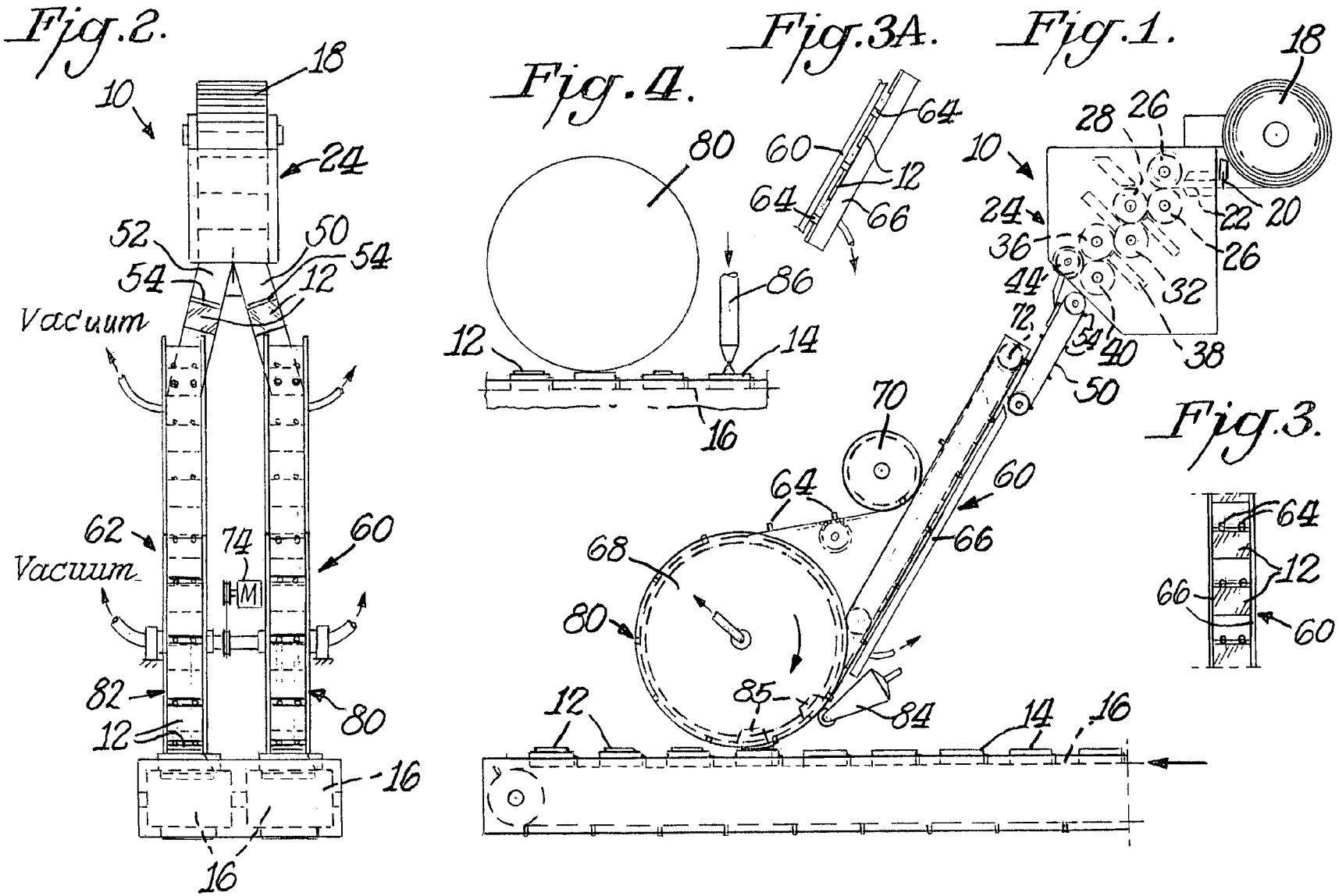
FIG. 1 is a schematic side elevational view of a machine for folding and applying onserts onto cigarette packs, according to the present invention.
FIG. 2 is a left end elevational view of the machine shown in FIG. 1, according to the present invention.
FIG. 3 is a fragmental right end elevational view of the machines shown in FIG. 1, particularly illustrating one of the lug belt conveyors and with the onserts against the lugs, according to the present invention.
FIG. 3A is an enlarged fragmental side elevational view of the onserts being pushed in a downstream direction by the lugs of the lug belt conveyor.
FIG. 4 is a fragmental side elevational view of an alternative arrangement for applying folded onserts onto cigarette packs, according to the present invention.

Referring in more particularity to the drawings, FIG. 1 illustrates the components of a machine 10 for folding and applying printed onserts 12 onto consumer goods such as cigarette packs 14 traveling along a pair of parallel horizontal conveyor belts 16. Fundamentally, the preprinted onserts 12 are folded, transported and ultimately applied to the cigarette packs as they travel along the conveyor belts 16.

Machine 10 includes a continuous roll 18 of preprinted onserts. The roll is sufficiently wide so that two onserts are printed on the roll in side-by-side relationship. As explained more fully below, after the folding operation, the pair of folding onserts is longitudinally cut to thereby provide a pair of individual onserts.

Immediately downstream from the continuous roll of preprinted onserts, a transverse cutter assembly 20 is provided constructed and arranged to cut onsert segments 22 from the continuous roll. As noted above, each onsert segment 22 includes a pair of side-by-side preprinted onserts.

Figure 5:
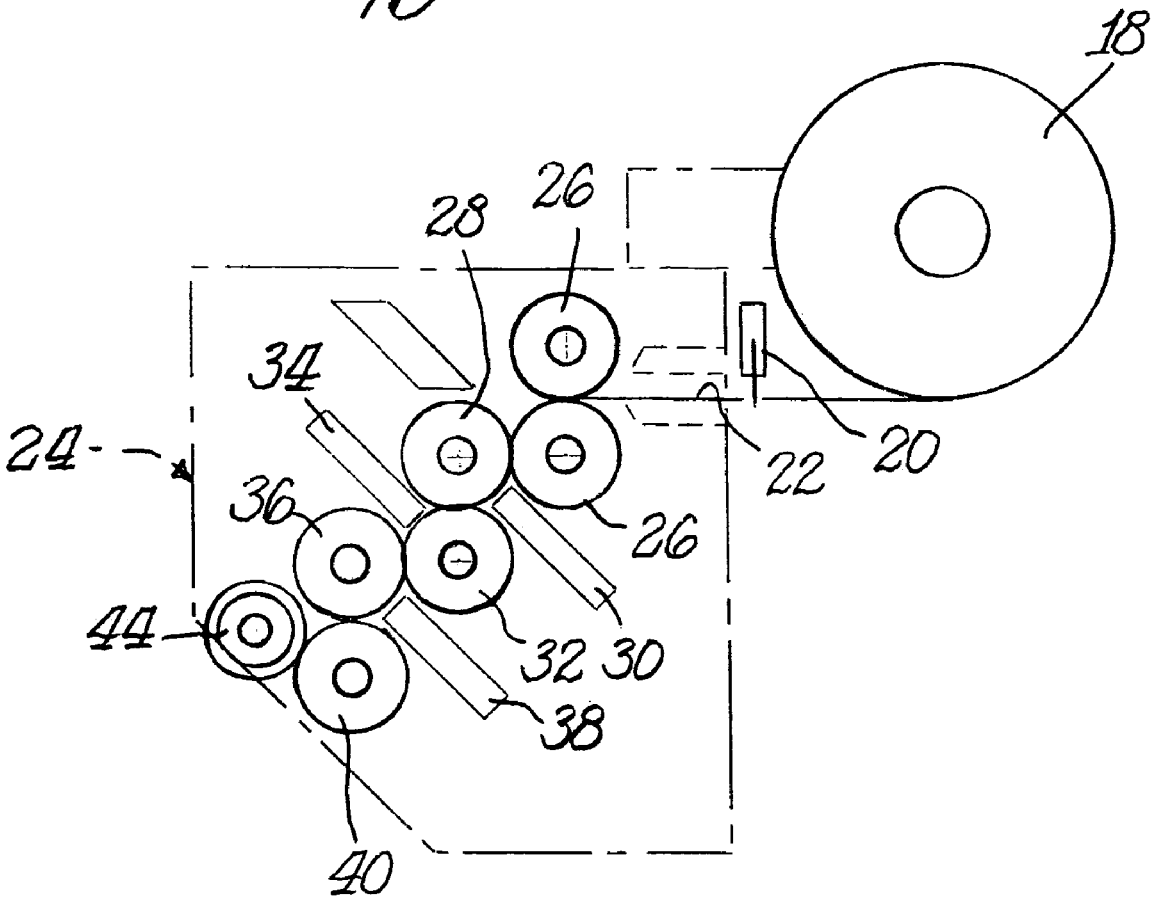
FIG. 5 is a cross sectional view in elevation of the buckle folder of the machine of FIG. 1 for producing folded onserts from an endless supply of stock, according to the present invention.

A buckle folder 24 is positioned downstream from the transverse cutter assembly 20 to receive each cut onsert segment 22 and to fold such segment along at least one transverse fold line. The buckle folder 24 illustrated in FIG. 1 as well as enlarged FIG. 5 is constructed and arranged to fold each segment 22 along three fold lines. An accelerator belt (not shown) may be positioned between the transverse cutter assembly 20 and the buckle folder 24 to deliver the onsert segments into the first roller nip of the folder.

Buckle folders generally function to produce folds in paper goods by stopping the forward end of a paper substrate while continuing to move the remainder of the substrate thereby causing it to buckle downwardly into a roller nip which produces the fold. Mechanisms of this general type are described in U.S. Pat. Nos. 4,125,254 and 6,224,560, both of which are incorporated herein by reference for all useful purposes. Fundamentally, buckle folder 24 includes a pair of rollers 26 at the entrance of the folder for receiving the printed onsert segment 22 and delivering those segments through the folder. Immediately after passing through the nip of entrance rollers 26 the onsert segment is fed between roller pair 26, 28 until the forward boundary of the segment 22 strikes a stop in first fold pan or chute 30. The onsert then buckles downwardly into the nip of a first fold roller pair 28, 32, and a first longitudinal fold is imparted to the preprinted onsert segment. The segment is then fed and bucked in seriatim into a second fold pan or chute 34 and then through a second fold roller pair comprising roller 32 and roller 36 which produces a second longitudinal fold line. Next the partially folded onsert segment enters a third pan or chute 38, buckles downwardly and passes through a third fold roller pair comprising roller 36 and roller 40.

A longitudinal cutter blade 44 is positioned at the exit end of the buckle folder 24 to longitudinally cut each folded segment 22 into a pair of individual onserts 12. The cutter blade rotates and bears against roller 40 as the onsert segment 22 passes between the nip of roller 40 and cutter blade 44.

A transport system 48 immediately downstream from the longitudinal cutter blade 44 serially receives the individual folded onserts 12 after the longitudinal cutting operation. As shown best in FIG. 2, the transport system 48 comprises a pair of diverging conveyor belts 50, 52 that move the individual onserts 12 along dual diverging paths. Each belt 50, 52 may include equally spaced raised projections 54 for retaining the onserts 12 in spaced relationship on the belts as the onserts travel in a downstream direction. Alternatively, diverging vacuum belts (not shown) may be used to transport onserts from the buckle folder in a downstream direction. Diverging pinch belts could also be used for this purpose.

A pair of spaced apart lug belt conveyors 60, 62 are positioned downstream of the diverging belts 50, 52 of the transport system 48. Each lug belt conveyor is arranged to receive the onserts from the discharge end of the diverging paths of the transport system 48. As shown best in FIGS. 1–3, each lug belt conveyor 60, 62 includes a plurality of equally spaced apart lugs 64 positioned along the length thereof and against which the onserts are located. Spaced apart rails 66 associated with lug belt conveyor 60, 62 include suction ports constructed and arranged to draw the onserts 12 onto the rails during transfer from the discharge end of the diverging belts 50, 52. The direction of the suction is such that each onsert 12 is drawn onto the rails and the rails are sufficiently close to the lug belts so that the lugs 64 engage the trailing edge of each onsert 12, as shown best in FIG. 3A. The onserts slide along the rails by the pushing action of the lugs on the lug belt conveyors. Each lug belt conveyor is trained around a main pulley 68 and several idler pulleys 70, 72. A motor 74 is connected to drive the lug belt conveyors 60, 62 by rotating each main pulley 68.

A pair of spaced apart applicator wheels 80, 82 function to transfer the onserts from the lug belt conveyors 60, 62 onto the spaced apart cigarette packs 12 traveling directly beneath the applicator wheels. A glue device 84 adjacent each lug belt conveyor applies adhesive to each onsert 12 prior to application to the cigarette packs. At the point of transfer of the onserts to the applicator wheel packs, the lugs 64 on the conveyors slightly retract to enable smooth transfer and application of the onserts onto the cigarette packs. Equally spaced apart suction cups 85 on the applicator wheels draw the onserts 12 onto the wheels in equally spaced apart relationship.

The spacing between the lugs 62 of each lug belt conveyor 60, 62 generally corresponds to the spacing between the cigarette packs 12 traveling directly below the applicator wheels 80, 82. The spacing between the suction cups 85 is also the same.

FIG. 4 shows an alternative arrangement where glue from device 86 is deposited upon each cigarette packs prior to application of the onserts onto the packs. With this arrangement the glue applicator 84 is not necessary.

The present invention may be used in combination with a Focke 750 wrapping machine which includes dual paths for flexible outer wrap material for application to cigarette packs traveling along dual paths. When the present invention is used with the Focke 750 wrapper, the onserts from the applicators are applied to the cigarette packs and the outer wrap is then wrapped around each pack.

Any adhesive may be used to fasten the folded onserts directly to the cigarette packs. Hot melt and heat activated adhesive are a few examples.

Although the buckle folder described above functions to produce a four panel, three fold line onsert, other arrangements are also possible by modifying the rollers of the folder. For example, by removing the last chute 38 and roller 40, a three panel, two fold line onsert may be produced.

We claim:

1. A machine for folding and applying onserts onto goods comprising:

a feeder for dispensing onserts from a continuous roll of onserts;

a cutter and folder assembly, the output of which comprises individual folded onsert in side-by-side relationship to one another;

a transport system serially receiving the individual folded onserts and moving the onserts along diverging paths;

a pair of spaced apart lug belt conveyors constructed and arranged to receive onserts from the diverging paths of the transport system;

each lug belt conveyor including spaced apart transverse lugs along the length thereof against which the onserts are positioned; and a pair of spaced apart applicators constructed and arranged to transfer the onserts from the lug belt conveyors onto spaced apart goods traveling past the applicators.

2. A machine for folding and applying onserts onto goods comprising:

a feeder for dispensing a continuous roll portion from a roll of onserts;

a transverse cutter assembly constructed and arranged to cut onsert segments from the continuous roll portion, each onsert segment including a pair of side-by-side onserts;

a buckle folder constructed and arranged to receive each cut onsert segment from the continuous roll portion and fold the segment along at least one transverse fold line so as to establish a pair of folded side-by-side onserts;

a longitudinal cutter constructed and arranged to longitudinally cut each folded segment so as to establish a pair of cut-apart side-by-side onserts;

a transport system serially receiving the folded, cut-apart onserts and moving the onserts along diverging paths;

a pair of spaced apart lug belt conveyors constructed and arranged to receive onserts from the diverging paths of the transport system;

each lug belt conveyor including spaced apart transverse lugs along the length thereof against which the onserts are positioned; and a pair of spaced apart applicators arranged to transfer the onserts from the lug belt conveyors onto spaced apart goods traveling past the applicators.

3. A machine as in claim 2 including a glue device for applying glue to each onsert prior to transfer of the onserts onto the goods.

4. A machine as in claim 2 including a glue device for applying glue to the goods prior to transfer of the onserts onto the goods.

5. A machine as in claim 2 including a pair of stationary suction rails associated with each lug belt conveyor in direct contact with the onserts for holding the onserts on the rails with the lugs between the rails and engaging the onserts for movement thereof in a downstream direction sliding along the suction rails.

* * * * *